US008551324B2

(12) United States Patent
Feugnet et al.

(10) Patent No.: US 8,551,324 B2
(45) Date of Patent: Oct. 8, 2013

(54) FLUID CATALYTIC CRACKING PROCESS ADAPTED FOR THE TREATMENT OF FEEDS WITH A LOW CONRADSON CARBON, COMPRISING RECYCLING A COKING CUT EMPLOYING NOVEL TECHNOLOGY

(75) Inventors: Frederic Feugnet, Lyons (FR); Romain Roux, Rueil-Malmaison (FR)

(73) Assignee: IFP Energies nouvelles, Rueil-Malmaison Cedex (FR)

( * ) Notice: Subject to any disclaimer, the term of this patent is extended or adjusted under 35 U.S.C. 154(b) by 187 days.

(21) Appl. No.: 13/272,685

(22) Filed: Oct. 13, 2011

(65) Prior Publication Data

US 2012/0091037 A1 Apr. 19, 2012

(30) Foreign Application Priority Data

Oct. 14, 2010 (FR) ..... 10 04046

(51) Int. Cl.

| | |
|---|---|
| ***C10G 51/04*** | (2006.01) |
| ***C10G 51/02*** | (2006.01) |
| ***C10G 47/30*** | (2006.01) |
| ***C10G 11/18*** | (2006.01) |
| ***B01J 8/34*** | (2006.01) |
| ***B01J 8/26*** | (2006.01) |

(52) U.S. Cl.

USPC ..... 208/74; 208/46; 208/49; 208/67; 208/72; 208/76; 208/77; 208/106; 208/108; 208/113; 208/118; 422/129; 422/139; 422/144; 422/145; 422/147

(58) Field of Classification Search

USPC ..... 208/49, 67, 74, 76, 77, 106, 113, 118; 422/129, 139, 144, 145, 147

See application file for complete search history.

(56) References Cited

U.S. PATENT DOCUMENTS

| | | | | |
|---|---|---|---|---|
| 3,489,673 | A | 1/1970 | Stine et al. | |
| 4,042,489 | A | 8/1977 | Fahrig et al. | |
| 5,098,554 | A | 3/1992 | Krishna et al. | |
| 7,220,351 | B1 * | 5/2007 | Pontier et al. | 208/113 |
| 2001/0031227 | A1 * | 10/2001 | Lomas | 422/144 |

FOREIGN PATENT DOCUMENTS

| | | | |
|---|---|---|---|
| GB | 1 285 791 | A | 8/1972 |
| WO | 93/22400 | A1 | 11/1993 |

OTHER PUBLICATIONS

Search Report, dated May 26, 2011, issued in corresponding FR 10/04.046.

* cited by examiner

*Primary Examiner* — Walter D Griffin
*Assistant Examiner* — Derek Mueller
(74) *Attorney, Agent, or Firm* — Millen, White, Zelano & Branigan, P.C.

(57) ABSTRACT

The present invention describes a process for the production of gasoline in a fluid catalytic cracking unit having at least one principal reactor operating using feeds with a low Conradson Carbon and a high hydrogen content, said process comprising recycling a coking cut either to a side chamber branching off the stripper or within the stripper itself by means of a tubular vessel within said stripper.

17 Claims, 3 Drawing Sheets

FLUID CATALYTIC CRACKING PROCESS ADAPTED FOR THE TREATMENT OF FEEDS WITH A LOW CONRADSON CARBON, COMPRISING RECYCLING A COKING CUT EMPLOYING NOVEL TECHNOLOGY

FIELD OF THE INVENTION

The present invention relates to the field of fluid catalytic cracking of oil cuts, more particularly cuts having a low Conradson Carbon and a high hydrogen content and for which it is therefore difficult to obtain a thermal balance for the unit.

In a fluid catalytic cracking unit (denoted FCC), the thermal balance is provided by the combustion of coke deposited on the catalyst during the reaction step. That combustion takes place in the regeneration zone. Typically, the catalyst enters the regeneration zone with a coke content (defined as the mass of coke over the mass of catalyst) in the range 0.5 to 1 and leaves said zone with a coke content of less than 0.01.

The Conradson carbon residue (abbreviated to CCR) of the feed (defined by US standard ASTM D 482) provides an evaluation of the production of coke during fluid catalytic cracking. The coke yield, which depends on the Conradson carbon residue of the feed, dictates the specific dimensions of the unit required to satisfy the thermal balance.

Conventional heavy feeds treated in a FCC unit generally have Conradson Carbons in the range 0.2% to 10%.

The cuts treated in a FCC unit of the present invention may have Conradson Carbons of less than 0.1 and hydrogen contents of more than 12.7%.

EXAMINATION OF THE PRIOR ART

It is known in the art to recycle to the regenerator a cut originating from FCC with a high coke potential, termed the coking cut, which is generally the "slurry" cut, i.e. a predominantly aromatic 360° C.+ cut, or any hydrocarbon cut such as Fuel Oil No 2 or domestic fuel. Such recycling of a "slurry" cut or a Fuel Oil No 2 cut to the regenerator is problematic since, because of the temperatures prevailing in the regenerator, of the order of 650° C. to 750° C., a portion of that recycle vaporises, forming cracked gases which will be found in the diluted phase of the regenerator, thus risking the creation of hot spots which can damage the proper operation of the unit. That phenomenon, frequently known as "afterburning", can be defined as a resurgence of combustion at an unwanted point in the unit, in particular at the inlet to the cyclone. In the remainder of the text, the term "afterburning", which is known and used in the art, will be used.

Furthermore, that recycle stream runs the risk of burning in the catalyst bed, forming therein a local high temperature flame front which can subject the catalyst to local high temperatures (hot spots). Those local high temperatures, combined with the presence of steam, weaken the active part of the catalyst (zeolite) and thus deactivate its cracking function.

The present invention describes a novel location for carrying out recycling of the coking cut which has a number of advantages, including that of avoiding the formation of hot spots.

BRIEF DESCRIPTION OF THE INVENTION

Figure 1:
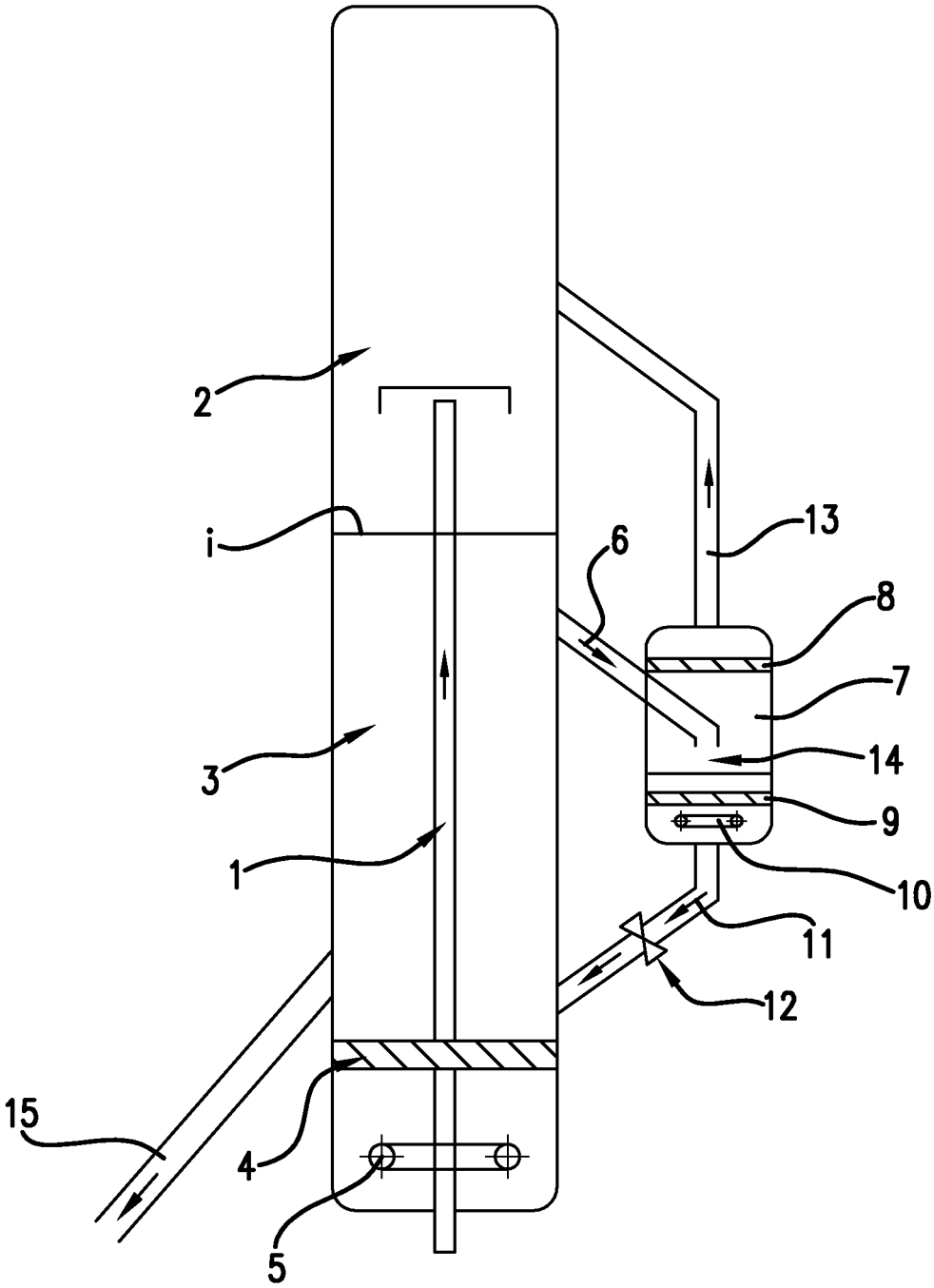
FIG. 1 is a flowchart of the process of the invention showing recycling of a coking cut in accordance with a first variation of the invention.

The present invention is applicable to FCC units employing a riser reactor and to units employing a downer reactor.

The present invention is also applicable to FCC units operating with a single reactor (riser or downer) and to FCC units operating with two reactors. In the remainder of the text, the term "principal reactor" denoted (1) will be used to designate the reactor orientated towards the production of gasoline, and the term "secondary reactor" will be used to designate the reactor dedicated to the production of propylene.

In general, when FCC units function with two reactors, a principal and a secondary reactor, these reactors are risers, but a unit which uses two downer reactors are also encompassed in the scope of the present invention.

Typically, the principal riser functions with a catalyst to feed ratio in the range 4 to 15, preferably in the range 5 to 10, and with riser outlet temperatures (denoted TS) in the range 480° C. to 580° C., preferably in the range 500° C. to 560° C.

Optimized conditions for the production of propylene in the secondary riser are obtained for outlet temperatures from said secondary riser in the range 550° C. to 650° C., preferably in the range 580° C. to 610° C., contact times in the range 20 ms to 500 ms, preferably in the range 50 ms to 200 ms (ms is the abbreviation for millisecond=$10^{-3}$ second), and solid flow rates in the range 150 to 600 kg/s/m$^2$.

The contact time is defined as the ratio of the volume of catalyst present in the reactor to the volumetric flow rate of fluid passing through the reactor under the operational reaction conditions.

This set of conditions means that the secondary riser is operated at catalyst to feed ratios (denoted C/O) in the range 8 to 35, preferably in the range 10 to 25.

The feeds that may be treated in a FCC unit in accordance with the present invention have feeds with Conradson Carbons of less than 0.1 and a hydrogen content of more than 12.7%.

Examples of this type of feed that may be cited are:

- purges from a hydrocracker unit known as "bleed", with a hydrogen content of more than 13%;
- VGO (vacuum gas oil) feeds, which have been intensely pre-treated, with a boiling point of more than 350° C., and having hydrogen contents of more than 12.7%;
- vegetable oils.

These feeds may be treated alone or as a mixture.

The present invention can be described as a process for the production of gasoline employing a fluid catalytic cracking unit having at least one principal reactor operating in riser mode or downer mode and a zone for regeneration of coked catalyst, said unit treating a feed with a Conradson Carbon of less than 0.1 and having a hydrogen content of more than 12.7%, in which a cut termed a coking cut is recycled, such as the following cuts, for example:

- LCO (abbreviation for light cycle oil) with a distillation range which is typically in the range 220° C. to 360° C.;
- HCO (abbreviation for heavy cycle oil) with a distillation range typically in the range 360° C. to 440° C.;
- "slurry" with a distillation range of more than 360° C. (denoted 360°+);
- or mixture of said cuts.

a) A first variation of the invention can be defined as a process for the production of gasoline employing a fluid catalytic cracking unit (FCC) having at least one principal reactor (1) operating in riser or downer mode, the coked catalyst from the reactor (1) outlet being introduced into a stripping zone, termed a stripper, operating in fluidized bed mode and having a dense phase (3) surmounted by a diluted phase (2), said unit processing a heavy cut with a Conradson Carbon of less than 0.1 and a hydrogen content of more than 12.7% by weight, in which process a recycle of one of the following cuts: LCO, HCO or slurry, or any mixture of said cuts, termed the coking cut, is carried out in a fluidized side chamber (7) branching off the stripper, i.e. along a transfer line (6), (11), the upper portion of the transfer line (6) having its origin at an upper point of the dense phase (3) of the stripper and the lower portion of the transfer line (11) having its return to the dense phase (3) of said stripper at a point located below the upper point, said side chamber (7) being placed upstream of a valve (12) for regulating the flow rate of the catalyst, placed on the lower portion of the transfer line (11) and being provided with a vent line (13) allowing the gases produced to be returned to the diluted phase (2) of the stripper, said side chamber (7) further comprising in its lower portion a lower packing (9) located below the point for introducing the recycle stream (14), and in its upper portion an upper packing (8) located above the point for introducing catalyst via the transfer line (6), in which process the flow rate for withdrawing catalyst introduced into the side chamber (7) is in the range 50 to 100 $kg/m^2/s$ and the overall residence time for said catalyst in the side chamber (7) is in the range 20 to 100 seconds.

In a particular configuration of the first variation, the catalyst removed from the dense phase (3) of the stripper and supplied to the side chamber (7) is introduced into the diluted phase of said side chamber (7) by means of a dispersion device.

b) in a second variation, the present invention can be defined as a process for the production of gasoline employing a fluid catalytic cracking unit (FCC) having at least one principal reactor (1) operating in riser or downer mode, the coked catalyst leaving the reactor outlet being introduced into a stripping zone, termed a stripper, operating in fluidized bed mode and having a dense phase (3) surmounted by a diluted phase (2), said unit processing a heavy cut with a Conradson Carbon of less than 0.1 and a hydrogen content of more than 12.7% by weight, in which process a recycle of one of the following cuts: LCO, HCO or slurry, or any mixture of said cuts, termed the coking cut, is carried out in a tubular vessel (17) placed inside the stripper, the upper end of said tubular vessel (17) opening into the diluted phase (2) of the stripper, and the lower end of said vessel (17) opening into the dense phase (3) of the stripper.

In a preferred configuration of the second variation of the invention, the tubular vessel (17) is positioned such that the portion immersed in the dense phase (3) of the stripper represents in the range 30% to 100% of the total length of said tubular vessel.

c) In a third variation, the present invention can be defined as a process for the production of gasoline employing a fluid catalytic cracking unit (FCC) having at least one principal reactor (1) operating in riser or downer mode, the coked catalyst leaving the reactor outlet being introduced into a stripping zone, termed a stripper, operating in fluidized bed mode and having a dense phase (3) surmounted by a diluted phase (2), said unit processing a heavy cut with a Conradson Carbon of less than 0.1 and a hydrogen content of more than 12.7% by weight, in which process a recycle of one of the following cuts: LCO, HCO or slurry, or any mixture of said cuts, termed the coking cut, is carried out within the dense phase (3) of the stripper in a tubular vessel (17') immersed in said dense phase (3) between two tiers of packing, a lower packing and an upper packing.

The present invention in all of its variations is compatible with a process for the production of gasoline and for the co-production of propylene employing a fluid catalytic cracking unit having a principal riser (1) and a secondary riser operating in parallel to the principal riser and operating under more severe operating conditions than those of the principal riser, said secondary riser treating, as a mixture, an olefinic C4 C5 cut and/or a gasoline cut and/or a recycled C5, C6, C7 or C8 cut.

In such a two-riser fluid catalytic cracking process, the outlet temperature for the principal riser (1) is generally in the range 480° C. to 580° C., preferably in the range 500° C. to 560° C., and the C/O ratio is generally in the range 4 to 15, preferably in the range 5 to 10.

In such a two-riser fluid catalytic cracking process, the outlet temperature for the secondary riser is generally in the range 550° C. to 650° C., preferably in the range 580° C. to 610° C., and the contact time is generally in the range 20 to 500 ms [millisecond], preferably in the range 50 ms to 200 ms.

Finally, in the context of the present invention, the coking cut recycle may also in part contain a cut from outside the FCC unit of the following type:

biomass of the wood or cellulose type;
liquid hydrocarbon product originating from oil;
ground coal;
asphalt-rich cut deriving from a deasphalting unit;
wax deriving from an indirect coal liquefaction unit (GTL);
petroleum coke;
or a mixture of said cuts.

The principal aim of the present invention is to prevent the appearance of hot spots in the catalyst regeneration zone, as might be produced with a direct recycle to the regenerator (in accordance with the prior art), said hot spots acting to deactivate the catalyst. Another aim of the present invention is to avoid the phenomenon of afterburning as described above.

DETAILED DESCRIPTION OF THE INVENTION

Figure 2:
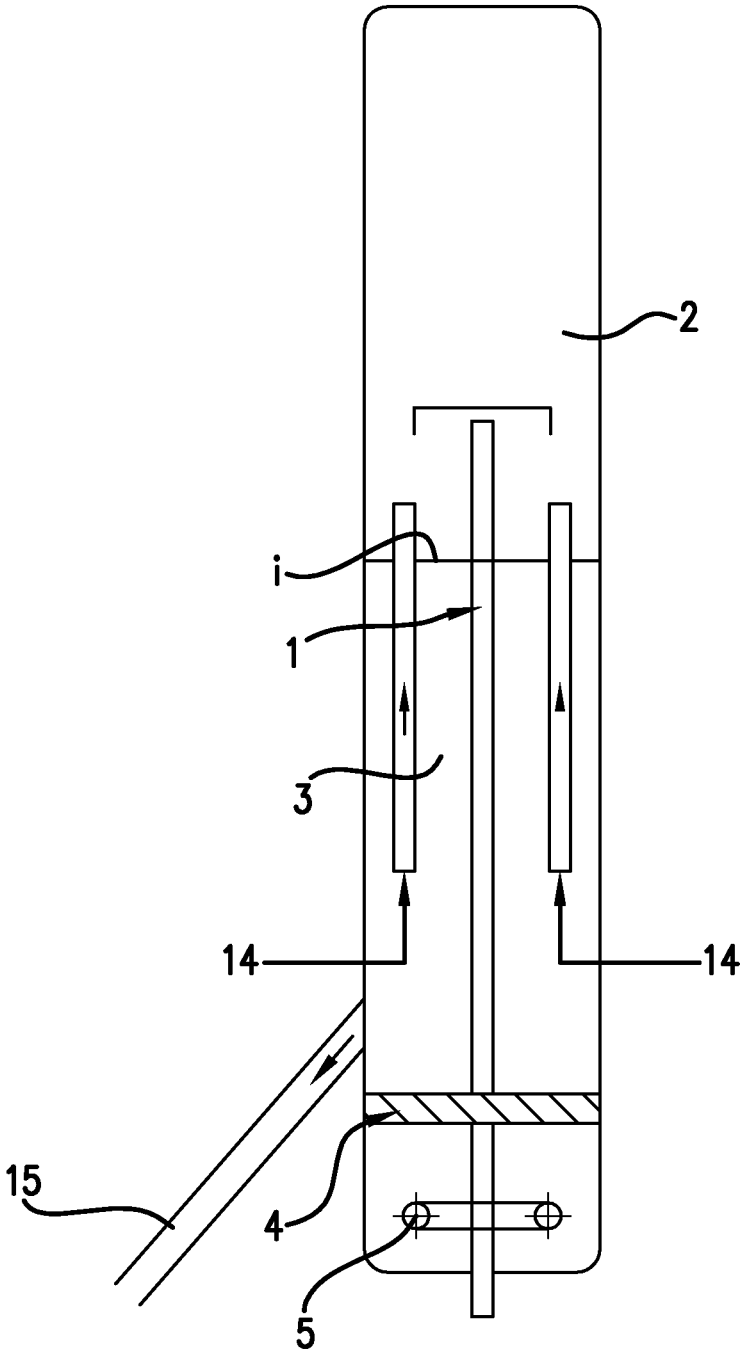
FIG. 2 is a flowchart of the process of the invention showing recycling of a coking cut in accordance with a second variation of the invention.
Figure 3:
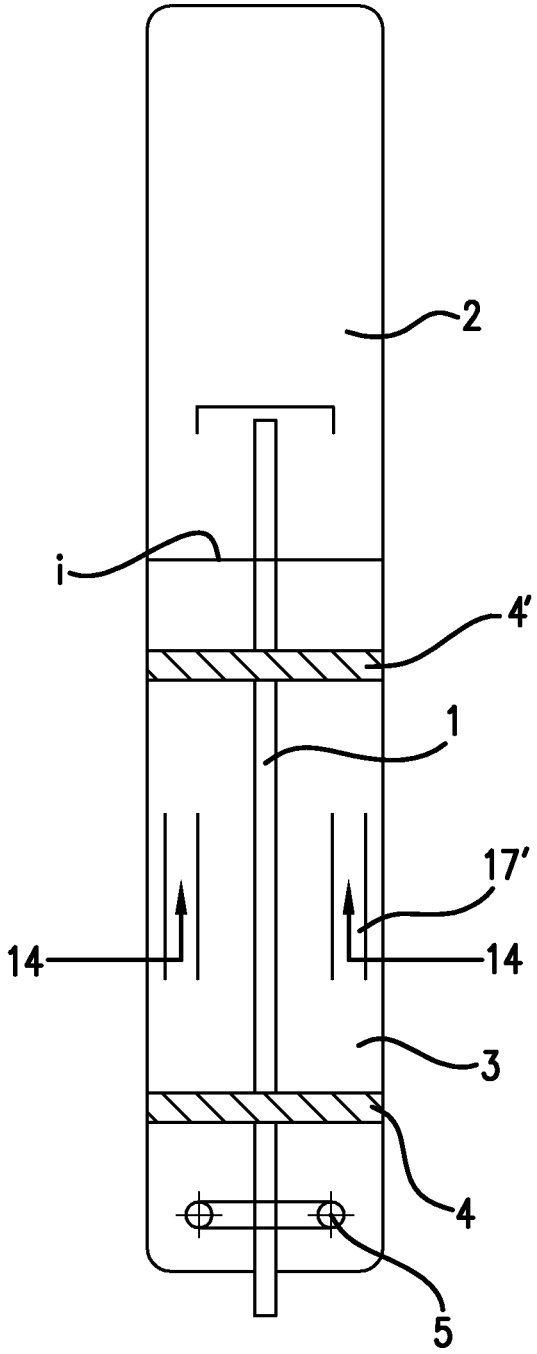
FIG. 3 is a flowchart of the process of the invention showing recycling of a coking cut in accordance with a third variation of the invention.

The detailed description is made with the aid of FIGS. 1, 2 and 3 which represent the reaction portion of a FCC unit.

The three FIGS. 1, 2 and 3 all have in common the conventional structure of the reaction portion of a FCC unit, namely a riser (1) the upper portion of which is sealed in a stripper comprising a dense phase (3) and a diluted phase (2). The stripper is fluidized by a fluidization means (5) and an internal packing (4) is generally installed in the lower portion of the dense phase (3) of the stripper in order to reduce the entrainment of solid particles towards the diluted phase (2).

The transfer line (15) can guide the coked catalyst from the dense phase (3) of the stripper to the regeneration zone (not shown in FIGS. 1, 2 and 3).

a) In the first variation of the present invention, shown in FIG. 1, the coked catalyst is withdrawn from the upper portion of the dense phase of the stripper (3) by means of a transfer line (6) and is sent to a side chamber (7) operated in fluidized bed mode, hereinafter termed the side chamber (7). This side chamber is located along a catalyst transfer line (6, 11) extending from the catalyst withdrawal point to the point at which catalyst is re-introduced to the lower portion of the dense phase of the stripper (3) via the transfer line (11). The fluidized mode side chamber (7) is located upstream of a valve (12) for regulating the flow rate of the catalyst.

The recycle stream is brought into contact with the catalyst in the diluted phase of the side catalyst (7) in order to achieve good contacting of said recycle with the catalyst, thereby ensuring homogenous deposition of additional coke on the catalyst. The term "contacting" means the process of bringing the recycled stream and catalyst into intimate contact. Since the catalyst is in the fluidized state, this contacting process extends progressively to the whole of the catalyst contained in the fluidized side chamber (7).

The homogeneity of the deposition of the coke obtained is much better than in the case in which the recycle is introduced directly into the fluidized bed of the stripper or regenerator.

The recycle stream (14) may be injected via one or more injectors. In order to facilitate vaporisation of said recycle, vapour known as diluting vapour may be employed, as is the case with feed injectors.

In this first variation, the recycle stream (14) reacts with the hot catalyst, thereby forming gases and coke in the fluidized side chamber (7).

The gases deriving from cracking of the recycle stream are returned to the diluted phase (2) of the stripper via a vent line (13), thereby preventing them from being sent to the regenerator.

This arrangement avoids afterburning and the risk of hot spots in the regenerator.

In the side chamber (7), the coked catalyst is stripped by vapour, for example via a fluidization ring (10), which means that it can be relieved of volatile hydrocarbons which are also returned to the diluted phase (2) of the stripper via the vent line (13).

A lower packing (9) may be placed in the lower portion of the side chamber (7) in order to limit the entrainment of gas bubbles with the solid in the stripper.

In the same manner, an upper packing (8) located in the diluted phase of the side chamber (7) above the point for introducing catalyst via the transfer line (6), may be installed in order to limit the entrainment of solid with the gases and thus to retain gas/particle separation quality.

The flow rate regulating valve (12) placed on the transfer line (11) allowing catalyst to be returned from the side chamber (7) to the dense phase (3) of the stripper can regulate the level of the solid in said chamber. As a consequence, the flow rate of solid entering the side chamber (7) is regulated by adjusting the level of solid in the stripper.

The dimensions of the side chamber (7) are such that the overall residence time for the catalyst passing through said chamber and returning to the stripper is approximately the same as for the portion of solid which is not withdrawn, namely a total residence time in the range 10 to 150 seconds, preferably in the range 20 to 100 seconds.

The stream of solid in the fluidized side chamber (7) is limited to between 30 and 150 $kg/m^2/s$, preferably in the range 50 to 120 $kg/m^2/s$, in order to limit the entrainment of gas bubbles with the solid returning to the stripper.

b) In a second variation of the present invention, shown in FIG. 2, contacting of the catalyst and recycle stream (14) is carried out in one or more tubular chambers (17) located inside the stripper per se. Any geometry such as, for example, a chamber in the form of a half cylinder welded to the wall of the stripper, may also be envisaged.

Said tubular vessel (17) is located with its lower portion in the dense zone (3) of the stripper above the packing (4), if it exists, and with its upper portion in the dilute zone (2) of the stripper.

The recycle stream (14), possibly associated with dilution vapour, is injected into the lower portion of the tubular vessel (17) via one or more injectors.

Vaporisation of the recycle stream (14) will reduce the density of the solid in the tubular vessel (17). The difference in pressure between the upper portion of the tubular vessel (17) which operates in a diluted region and the lower portion of the catalyst (17), which operates in a dense region, causes circulation of solid inside said tubular vessel (17). This natural circulation of solid ensures good contacting of the recycle (14) with the catalyst. In the same manner as in the preceding embodiment, the limited volume of the tubular vessel (17) guarantees better contacting than if said recycle (14) were injected directly into the fluidized bed of a stripper or regenerator.

The flow rate of the solid in this second arrangement depends solely on the level of solid in the stripper, i.e. the interface between the dense phase (3) and the diluted phase (2), and can be regulated by adjusting that interface.

Cracking of the recycle stream (14) on the hot catalyst produces coke and gases.

The gases leave the tubular vessel (17) via the upper end of said chamber and are thus found in the diluted phase (2) of the stripper. No gas from cracking the recycle (14) is thus sent to the regenerator, and as a consequence afterburning and the formation of hot spots in this zone are avoided.

Stripping of the catalyst coked by the recycle (14) is ensured directly via the fluidization means (4) of the stripper without any additional intervention.

c) In a third variation of the present invention, shown in FIG. 3, contacting of the catalyst and recycle is carried out inside the stripper per se in a layer of bedding (4'), for example of the packing type, or between two layers of bedding of the packing type, for example (4 and 4').

Vaporisation of the recycle will create bubbles in the catalyst bed. The role of the upper layer of packing (4') is to break up the bubbles. This has a twin advantage. Firstly, it provides for optimized contacting between the catalyst and the smaller bubbles, enhancing mixing. This better contacting can enhance the conversion of the recycle into coke and into a fraction which is lighter than the recycle.

Secondly, it can distribute this gas in as uniform a manner as possible and thus limit entrainment of catalyst in the diluted phase (2) of the stripper. This entrainment is normally aggravated by large bubbles of gas bursting at the interface of the dense (3) and dilute (2) phases of the stripper. The upper layer of packing (4') thus functions as a mixer/contacter to promote the cracking reaction, but also to limit entrainment.

Stripping of the portion of solid coked by the recycle is carried out directly in the stripper without additional intervention or by adding a packing (4) below the recycle injection zone in order to enhance contacting between vapour and solid and also to limit the entrainment of gas bubbles with the solid in the direction of the regenerator.

COMPARATIVE EXAMPLE

In order to illustrate the effect desired in the present invention, we considered a first example termed the "basic example" corresponding to a fluid catalytic cracking (FCC) unit with a single riser with a chamber of 60000 barrels per day, i.e. 300 tonnes per hour, and processing a feed corresponding to a mixture of hydrocracker bleed and hydrotreated VGO.

The principal properties of the feed are shown in Table 1 below.

TABLE 1

| Principal properties of feed | | |
|---|---|---|
| Feed | | Bleed + HDT VGO |
| Density | g/cm$^3$ | 0.8552 |
| $H_2$ content | % by weight | 14.04 |
| Sulphur | ppm by weight | 170 |
| Nitrogen | ppm by weight | 298 |
| CCR | | <0.1 |
| Ni | ppm by weight | <2 |
| V | ppm by weight | <2 |

This unit, with a recycle of the slurry cut to the regenerator, was operated under the conditions shown in Table 2. The associated yield structure was obtained as follows:

1) In accordance with the prior art, by recycling the slurry cut to the regenerator. This resulted in cracking of said cut, generating the cracked gases inevitably formed on contact between the injected coking cut and the hot catalyst of the regenerator. These cracked gases represented approximately 2.1% by weight of the principal feed, i.e. a flow rate of 6.4 tonnes per hour, and are a source of hot spots when entrained in the diluted phase of the regenerator.
2) In accordance with the invention, as below.

TABLE 2

| Operating conditions | |
|---|---|
| Operating conditions | |
| C/O | 8.7 |
| Riser outlet temperature, ° C. | 525 |
| Delta coke | 0.54 |
| Temperature of regenerator | 650° C. |

TABLE 3

| Yield structure, basic case | |
|---|---|
| Yield structure with respect to feed | % by weight |
| Dry gases | 1.91 |
| LPG C3/C4 | 29.11 |
| C5 gasoline - 220° C. | 55.83 |
| LCO (220-360° C.) | 5.74 |
| >360° C. | 2.64 |
| Coke | 4.77 |

The yields of cracked gas and coke produced by cracking of the slurry in the regenerator are shown in Table 3 below.

TABLE 3

| Yield structure of products derived from cracking slurry recycled to the regenerator | |
|---|---|
| Yield structure with respect to recycled slurry | % by weight |
| Dry gases | 1.86 |
| LPG C3/C4 | 3.22 |
| C5 gasoline - 220° C. | 9.5 |
| LCO (220-360° C.) | 28.77 |
| >360° C. | 37.14 |
| Coke | 19.51 |

1) In the prior art, recycling of the slurry cut is carried out in the regenerator. This results in cracking of said cut, generating the cracked gases inevitably formed on contact between the injected coking cut and the hot catalyst of the regenerator. These cracked gases represent approximately 2.1% by weight of the principal feed, i.e. a flow rate of 6.4 tonnes per hour, and are a source of hot spots when they are entrained in the diluted phase of the regenerator.
2) In accordance with the invention, recycling the slurry cut from the unit per se takes place in a fluidized side chamber (7) as shown in FIG. 1, placed on a transfer line (6) withdrawing the catalyst from the upper portion of the dense phase (3) of the stripper. The coked catalyst leaves the fluidized side chamber (7) via a transfer line (11) returning said catalyst to the lower portion of the dense phase (3) of the stripper.

The fluidized side chamber (7) is placed upstream of the valve (12) for regulating the flow rate of catalyst and has a vent line (13) connecting the diluted phase of said chamber with the diluted phase (2) of the stripper.

The recycle stream is brought into contact with the catalyst in the diluted phase of the side chamber (7) in order to carry out proper contacting of said recycle with the catalyst, thereby ensuring properly homogenous deposition of additional coke on the catalyst.

The dimensions of the fluidized side chamber (7) were such the overall contact time was 70 seconds and the solid flow rate was 65 kg/m$^2$/s.

A lower packing (9) was located in the lower portion of the dense phase of the side chamber (7).

An upper packing (8) was placed in the diluted phase of the side chamber (7).

The total delta coke of the system changed from 0.54 in the prior art to 0.61 in the case of the present invention.

The temperature of the regenerator changed in correlation from 650° C. to 658° C. for the same quantity of slurry used, due to better contacting of the recycle stream with the catalyst of the present invention.

The recycle of the slurry cut bypassing the stripper in the fluidized side chamber (7) thus can properly ensure the thermal balance in the unit with a particularly advantageous effect as regards the prior art which originates both from the location of the point for recycling diluted phase from the fluidized chamber (7) and the vent line (13), which means that the phenomenon of afterburning can be avoided by preventing cracked gases from being entrained in the regenerator.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding FR application No. 10/04.046, filed Oct. 14, 2010, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of gasoline employing a fluid catalytic cracking unit (FCC) having at least one principal reactor (1) operating in riser or downer mode, the coked catalyst from the reactor (1) outlet being introduced into a stripping zone, termed a stripper, operating in fluidized bed mode and having a dense phase (3) surmounted by a diluted phase (2), said unit processing a heavy cut with a Conradson Carbon of less than 0.1 and a hydrogen content of more than 12.7% by weight, in which process a recycle of one of the following cuts: LCO, HCO or slurry, or any mixture of said cuts, termed the coking cut, is carried out in a fluidized side chamber (7) branching off the stripper, i.e. along a transfer line (6), (11), the upper portion of the transfer line (6) having its origin at an upper point of the dense phase (3) of the stripper and the lower portion of the transfer line (11) having its return to the dense phase (3) of said stripper at a point located below the upper point, said side chamber (7) being placed upstream of a valve (12) for regulating the flow rate of the catalyst, placed on the lower portion of the transfer line (11) and being provided with a vent line (13) allowing the gases produced to be returned to the diluted phase (2) of the stripper, said side chamber (7) further comprising in its lower portion a lower packing (9) located below the point for introducing the recycle stream (14), and in its upper portion an upper packing (8) located above the point for introducing catalyst via the transfer line (6), in which process the flow rate for withdrawing catalyst introduced into the side chamber (7) is in the range 50 to 100 $kg/m^2/s$ and the overall residence time for said catalyst in the side chamber (7) is in the range 20 to 100 seconds.

2. A process for the production of gasoline using a fluid catalytic cracking unit (FCC) according to claim 1, in which the catalyst withdrawn from the dense phase (3) of the stripper and supplied to the side chamber (7) is introduced into the diluted phase of said vessel by a dispersion device.

3. A process for the production of gasoline employing a fluid catalytic cracking unit (FCC) having at least one principal reactor (1) operating in riser or downer mode, the coked catalyst leaving the reactor outlet being introduced into a stripping zone, termed a stripper, operating in fluidized bed mode and having a dense phase (3) surmounted by a diluted phase (2), said unit processing a heavy cut with a Conradson Carbon of less than 0.1 and a hydrogen content of more than 12.7% by weight, in which process a recycle of one of the following cuts: LCO, HCO or slurry, or any mixture of said cuts, termed the coking cut, is carried out in a tubular vessel (17) placed inside the stripper, the upper end of said vessel (17) opening into the diluted phase (2) of the stripper, and the lower end of said vessel (17) opening into the dense phase (3) of the stripper.

4. A process for the production of gasoline employing a fluid catalytic cracking unit (FCC) having at least one principal reactor (1) operating in riser or downer mode, the coked catalyst leaving the reactor outlet being introduced into a stripping zone, termed a stripper, operating in fluidized bed mode and having a dense phase (3) surmounted by a diluted phase (2), said unit processing a heavy cut with a Conradson Carbon of less than 0.1 and a hydrogen content of more than 12.7% by weight, in which process a recycle of one of the following cuts: LCO, HCO or slurry, or any mixture of said cuts, termed the coking cut, is carried out within the dense phase (3) of the stripper in a tubular vessel (17') immersed in said dense phase (3) between two tiers of packing, a lower packing and an upper packing.

5. A process for the production of gasoline using a fluid catalytic cracking unit according to claim 3, in which the tubular vessel (17) is positioned such that the portion immersed in the dense phase (3) of the stripper represents in the range 30% to 100% of the total length of said tubular vessel (17).

6. A process for the production of gasoline and for the co-production of propylene employing a fluid catalytic cracking unit according to claim 1, having a principal riser (1) and a secondary riser operating in parallel to the principal riser and operating under more severe operating conditions than those of the principal riser, said secondary riser treating, as a mixture, an olefinic C4 C5 cut and/or a gasoline cut and/or a recycled C5, C6, C7 or C8 cut.

7. A process for the production of gasoline employing a fluid catalytic cracking unit according to claim 6, in which an outlet temperature for the principal riser (1) is in the range 480° C. to 580° C., and a C/O ratio is in the range 4 to 15, and an outlet temperature for the secondary riser is in the range 550° C. to 650° C., and a contact time is in the range 20 to 500 ms.

8. A process for the production of gasoline employing a fluid catalytic cracking unit according to claim 1, in which the coking cut recycle also in part contains a cut from outside the FCC unit of the following type:

biomass of the wood or cellulose type;
liquid hydrocarbon product originating from oil;
ground coal;
asphalt-rich cut deriving from a deasphalting unit;
wax deriving from an indirect coal liquefaction unit (GTL);
petroleum coke;
or a mixture of said cuts.

9. A process for the production of gasoline employing a fluid catalytic cracking unit according to claim 7, in which the outlet temperature for the principal riser (1) is in the range 500° C. to 560° C., or the C/O ratio is in the range 5 to 10, or the outlet temperature for the secondary riser is in the range 580° C. to 610° C., or the contact time is in the range 50 ms to 200 ms.

10. A process for the production of gasoline and for the co-production of propylene employing a fluid catalytic cracking unit according to claim 3, having a principal riser (1) and a secondary riser operating in parallel to the principal riser and operating under more severe operating conditions than those of the principal riser, said secondary riser treating, as a mixture, an olefinic C4 C5 cut and/or a gasoline cut and/or a recycled C5, C6, C7 or C8 cut.

11. A process for the production of gasoline employing a fluid catalytic cracking unit according to claim 10, in which an outlet temperature for the principal riser (1) is in the range 480° C. to 580° C., and a C/O ratio is in the range 4 to 15, and an outlet temperature for the secondary riser is in the range 550° C. to 650° C., and a contact time is in the range 20 to 500 ms.

12. A process for the production of gasoline employing a fluid catalytic cracking unit according to claim 11, in which the outlet temperature for the principal riser (1) is in the range 500° C. to 560° C., or the C/O ratio is in the range 5 to 10, or the outlet temperature for the secondary riser is in the range 580° C. to 610° C., or the contact time is in the range 50 ms to 200 ms.

13. A process for the production of gasoline and for the co-production of propylene employing a fluid catalytic cracking unit according to claim 4, having a principal riser (1) and a secondary riser operating in parallel to the principal riser and operating under more severe operating conditions than those of the principal riser, said secondary riser treating, as a mixture, an olefinic C4 C5 cut and/or a gasoline cut and/or a recycled C5, C6, C7 or C8 cut.

14. A process for the production of gasoline employing a fluid catalytic cracking unit according to claim 13, in which an outlet temperature for the principal riser (1) is in the range 480° C. to 580° C., and a C/O ratio is in the range 4 to 15, and an outlet temperature for the secondary riser is in the range 550° C. to 650° C., and a contact time is in the range 20 to 500 ms.

15. A process for the production of gasoline employing a fluid catalytic cracking unit according to claim 14, in which the outlet temperature for the principal riser (1) is in the range 500° C. to 560° C., or the C/O ratio is in the range 5 to 10, or the outlet temperature for the secondary riser is in the range 580° C. to 610° C., or the contact time is in the range 50 ms to 200 ms.

16. A process for the production of gasoline employing a fluid catalytic cracking unit according to claim 3, in which the coking cut recycle also in part contains a cut from outside the FCC unit of the following type:

biomass of the wood or cellulose type;
liquid hydrocarbon product originating from oil;
ground coal;
asphalt-rich cut deriving from a deasphalting unit;
wax deriving from an indirect coal liquefaction unit (GTL);
petroleum coke;
or a mixture of said cuts.

17. A process for the production of gasoline employing a fluid catalytic cracking unit according to claim 4, in which the coking cut recycle also in part contains a cut from outside the FCC unit of the following type:

biomass of the wood or cellulose type;
liquid hydrocarbon product originating from oil;
ground coal;
asphalt-rich cut deriving from a deasphalting unit;
wax deriving from an indirect coal liquefaction unit (GTL);
petroleum coke;
or a mixture of said cuts.

* * * * *